US006976739B2

(12) United States Patent
Wang

(10) Patent No.: US 6,976,739 B2
(45) Date of Patent: Dec. 20, 2005

(54) ARMREST ASSEMBLY

(75) Inventor: Ching-Chang Wang, Taichung Hsien (TW)

(73) Assignee: Chuan Hsing Chemical Industry Co., Ltd., Taichung Hsien (TW)

( * ) Notice: Subject to any disclaimer, the term of this patent is extended or adjusted under 35 U.S.C. 154(b) by 0 days.

(21) Appl. No.: 10/822,470

(22) Filed: Apr. 12, 2004

(65) Prior Publication Data

US 2005/0225149 A1 Oct. 13, 2005

(51) Int. Cl.[7] ..... A47C 7/54
(52) U.S. Cl. ..... 297/411.35; 297/411.36; 297/411.2
(58) Field of Search ..... 297/411.35, 411.36, 297/411.2

(56) References Cited

U.S. PATENT DOCUMENTS 5,620,233 A * 4/1997 Corwin ..... 297/411.36
6,139,107 A * 10/2000 Lee ..... 297/411.36
6,209,961 B1 * 4/2001 Chen ..... 297/411.36
6,336,680 B1 * 1/2002 Lee ..... 297/411.36
6,398,309 B1 * 6/2002 Chen ..... 297/411.36
6,419,323 B1 * 7/2002 Chu et al. ..... 297/411.36
6,619,746 B2 * 9/2003 Roslund et al. ..... 297/411.36

* cited by examiner

*Primary Examiner*—Peter R. Brown
*Assistant Examiner*—Sarah C. Burnham
(74) *Attorney, Agent, or Firm*—Alan D. Kamrath; Nikolai & Mersereau, P.A.

(57) ABSTRACT

An armrest assembly includes a stationary tube for attachment to a chair. The stationary tube includes recesses in an internal face. A movable tube is inserted in the stationary tube. The movable tube includes an aperture. An armrest is installed on the movable tube. A detent can be inserted into one of the recesses of the stationary tube through the aperture of the movable tube. A rod is inserted in the movable tube. The rod defines a recess for receiving the detent. The recess of the rod includes a shallow portion and a deep portion. A lever is connected with the rod and installed on the armrest in order to move the rod so as to control the detent.

10 Claims, 12 Drawing Sheets

ARMREST ASSEMBLY

FIELD OF INVENTION

The present invention relates to an armrest assembly.

BACKGROUND OF INVENTION

Referring to FIGS. 11 and 12, a conventional armrest assembly includes a first tube 100, a second tube 200 telescopically inserted in the first tube 100, an X-shaped lock 220 for locking the second tube 200 in position relative to the first tube 100 and an armrest 300 installed on the second tube 200. The first tube 100 includes a base 110 to be secured to a chair (not shown) and many pairs of apertures 160. The second tube 200 includes two upper apertures 211, two lower apertures 212, two opposite apertures 260 and a platform 290 for supporting the armrest 300. The X-shaped lock 220 includes two members 225 each including an aperture 223, an upper tip 221 and a lower tip 222. A spring 240 is compressed between the members 225 near the upper tips 221. Another spring 240 is compressed between the members 225 near the lower tips 222. The X-shaped lock 220 is put in the second tube 200. A pin 270 is inserted into the apertures 223 through the apertures 260 so as to keep the X-shaped lock 220 in the second tube 200. The upper tips 221 are inserted through the upper apertures 211. A button 280 is attached to the upper tip 221 of each member 225. The lower tips 222 can be inserted into one of the pairs of apertures 160 through the lower apertures 211 so as to lock the second tube 200 in position relative to the first tube 100. Via pressing the buttons 280, the upper tips 221 are retreated into the upper apertures 211, i.e., the lower tips 222 are retreated into the lower apertures 212 from the apertures 160 so as to the allow movement of the second tube 200 relative to the first tube 100. It is, however, difficult to simultaneously push the buttons 280 since they are located under the armrest 300 and on two opposite sides of the second tube 200. Moreover, the springs 240 eventually become inadequate to keep the lower tips 222 in the apertures 160. If this happens, the lower tips 222 can easily be jerked from the apertures 160 and worn against the second tube 200 without previously pushing the buttons 280 when the armrest 300 is lifted unintentionally.

The present invention is therefore intended to obviate or at least alleviate the problems encountered in the prior art.

SUMMARY OF INVENTION

It is an objective of the present invention to provide a convenient armrest assembly.

It is another objective of the present invention to provide a robust armrest assembly.

It is another objective of the present invention to provide a reliable armrest assembly.

According to the present invention, an armrest assembly is disclosed. The armrest assembly includes a stationary tube for attachment to a chair.

The stationary tube includes recesses in an internal face. A movable tube is inserted in the stationary tube. The movable tube includes an aperture. An armrest is installed on the movable tube. A detent can be inserted into one of the recesses of the stationary tube through the aperture of the movable tube. A rod is inserted in the movable tube. The rod defines a recess for receiving the detent. The recess of the rod includes a shallow portion and a deep portion. A lever is connected with the rod and installed on the armrest in order to move the rod so as to control the detent.

Other objectives, advantages and novel features of the invention will become more apparent from the following detailed description in conjunction with the attached drawings.

BRIEF DESCRIPTION OF DRAWINGS

The present invention will be described via detailed illustration of embodiments referring to the drawings.

DETAILED DESCRIPTION OF EMBODIMENTS

Figure 1:
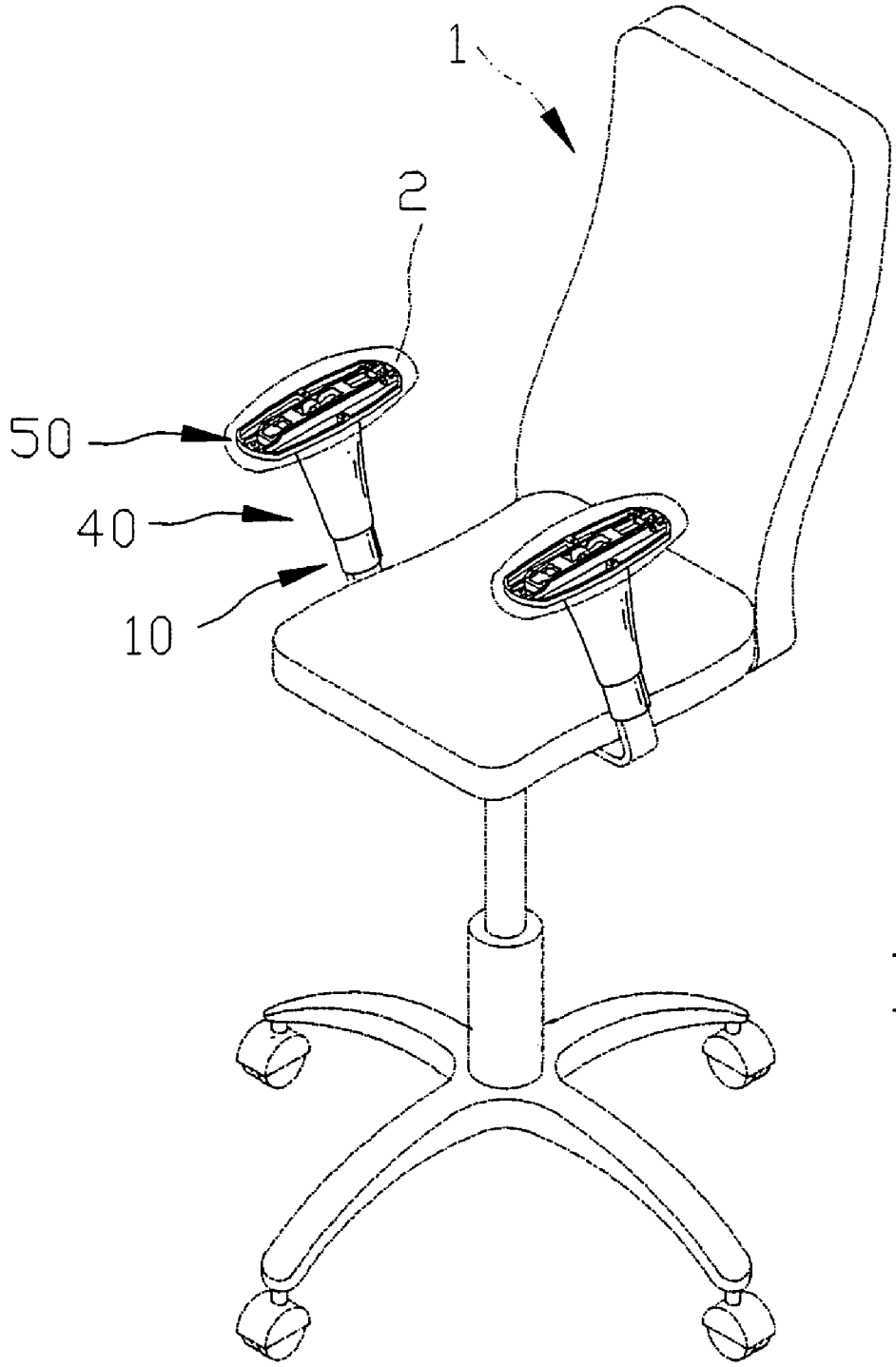
FIG. 1 is a perspective view of a chair equipped with two armrest assemblies according to a first embodiment of the present invention.
Figure 2:
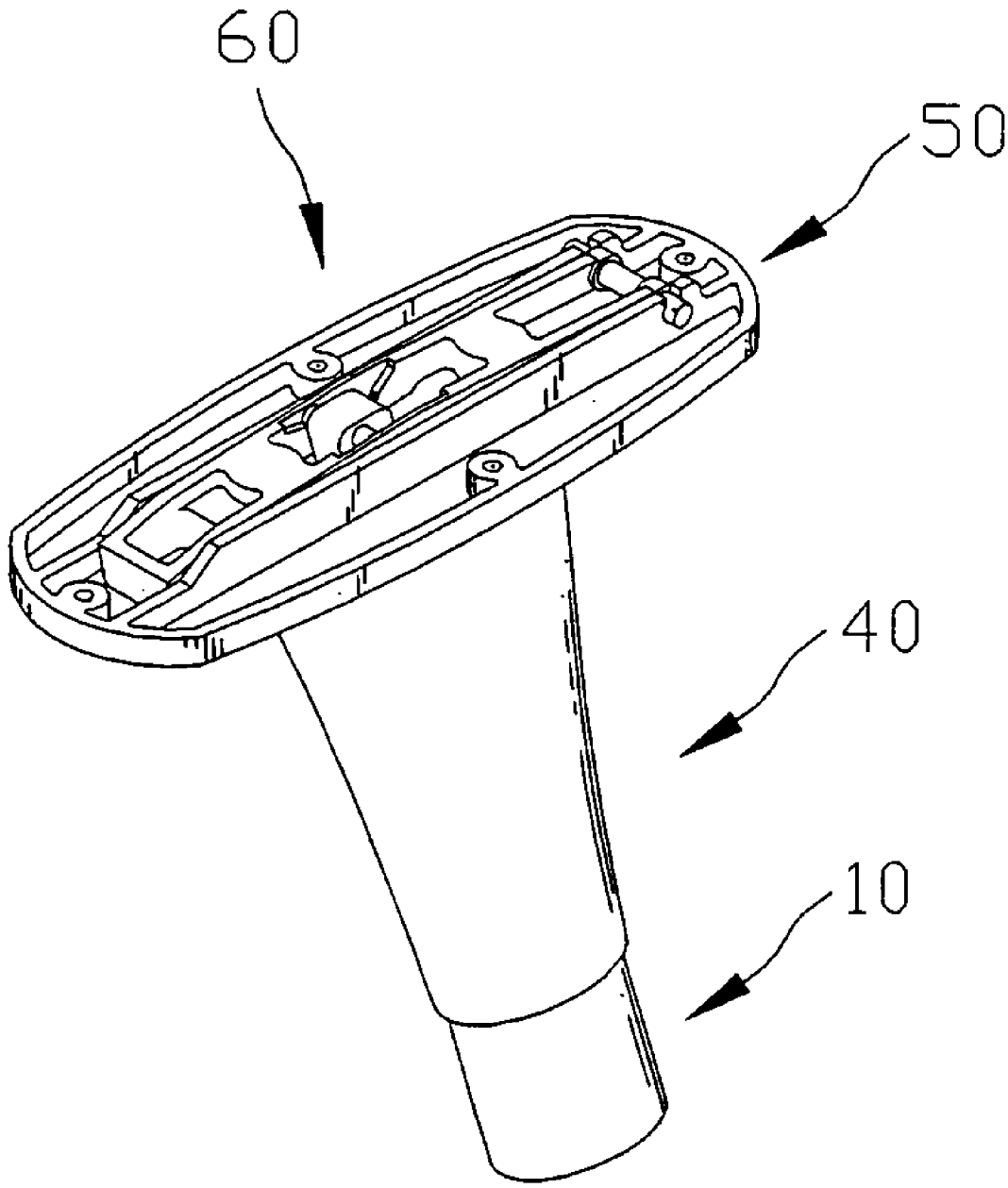
FIG. 2 is a perspective view of one of the armrest assemblies shown in FIG. 1.

FIG. 1 shows a chair 1 equipped with two armrest assemblies according to a first embodiment of the present invention. FIG. 2 shows only one of the armrest assemblies shown in FIG. 1.

Figure 3:
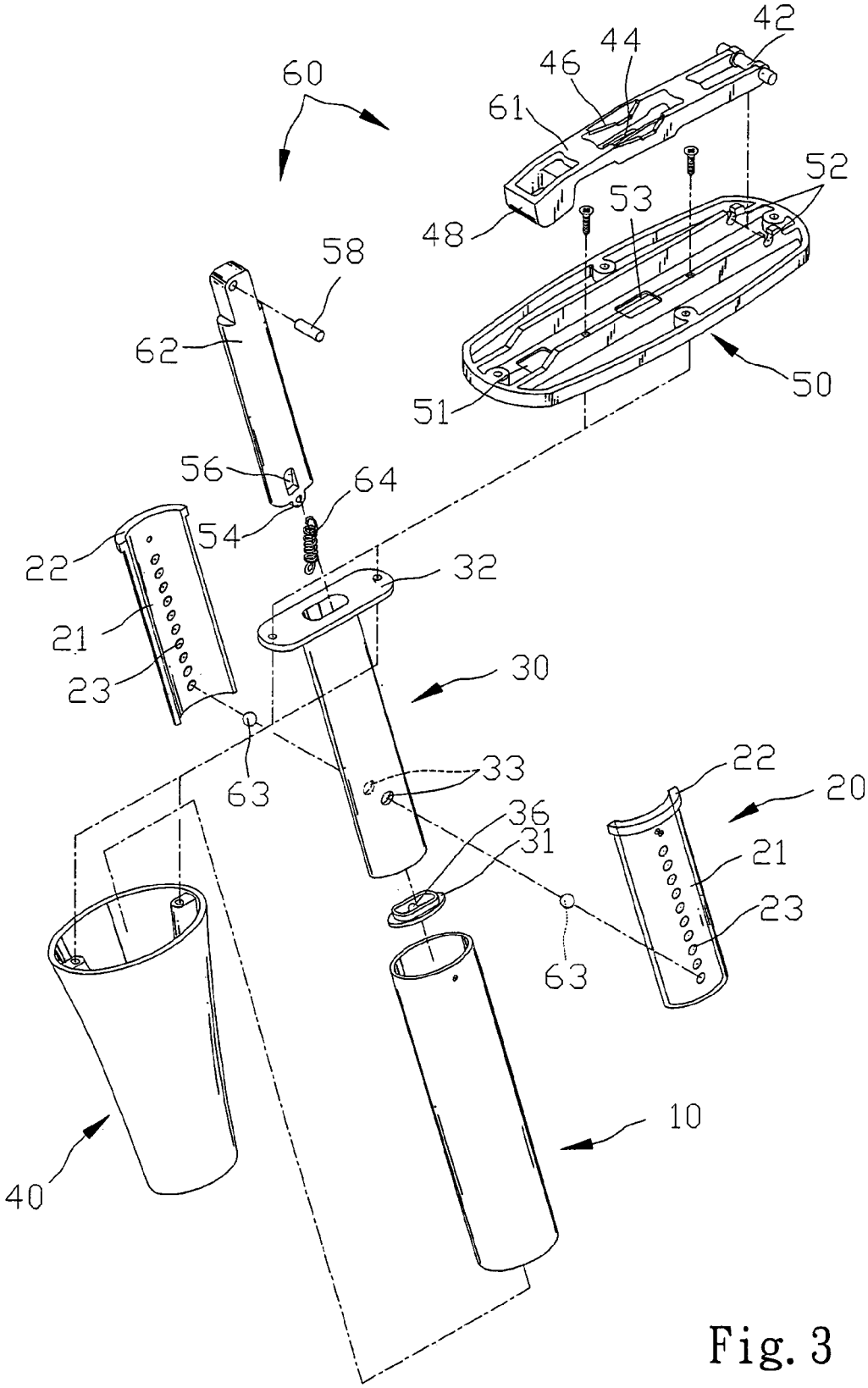
FIG. 3 is an exploded view of the armrest shown in FIG. 2.

Referring to FIGS. 2 and 3, the armrest assembly includes a first tube 10, a second tube 20 securely inserted in the first tube 10, a third tube 30 telescopically inserted in the second tube 20, an armrest 50 secured to the third tube 30 and a control device 60 for locking the third tube 30 in position relative to the second tube 20. A pad 2 is attached to the top of the armrest 50. A sleeve 40 is secured to the bottom of the armrest 50 in order to cover the third tube 30.

The second tube 20 includes two halves 21 each including a flange 22 formed thereon and many recesses 23 defined therein. The recesses 23 of the halves 21 make many pairs of recesses 23. Although made as two separate pieces in the first embodiment, the halves 21 may be merged in other embodiments. The halves 21 are secured in the first tube 10 with the flanges 22 resting on an upper edge of the first tube 10. Each of the halves 21 is secured to the first tube 10 by a pin (not shown), for example.

The third tube 30 includes a platform 32 formed thereon and two opposite apertures 33 of which only one is shown in FIG. 3. The third tube 30 is telescopically inserted in the second tube 20.

The armrest 50 includes two bearings 52 formed thereon, a first aperture 51 defined therein and a second aperture 53 defined therein. The armrest 50 is secured to the platform 32 by two screws (not numbered), for example.

The control device 60 includes two detents 63 for insertion into a pair of recesses 23 through the apertures 33, a rod 62 movably inserted in the third tube 30 for controlling the detents 63 and a lever 61 installed on the armrest 50 for controlling the rod 62.

The lever 61 is formed with a shaft 42. Moreover, the lever 61 includes an aperture 44 defined therein, two recesses 46 defined therein and a button 48 formed on the bottom thereof. The shaft 42 is installed on the bearings 52. The aperture 44 is aligned with the second aperture 53 of the armrest 50. The button 48 is inserted through the first aperture 51 of the armrest 50.

The detents 63 are both in the form of a ball.

The rod 62 includes an ear 54 formed thereon and two opposite recesses 56 defined therein in order to receive the detents 63. Each recess 56 includes a shallow portion and a deep portion. A pin 58 is driven into the rod 62, exposing two ends. The rod 62 is inserted in the third tube 30 through the aperture 44 of the lever 61 and the second aperture 53 of the armrest 50. Two ends of the pin 58 are put in the recesses 46. A plug 31 is fit in a lower end of the third tube 30. The plug 31 is formed with a rod 36. A tensile spring 64 includes a lower end hooking the rod 36 formed on the plug 31 and an upper end hooking the ear 54 formed on the rod 62.

Figure 4:
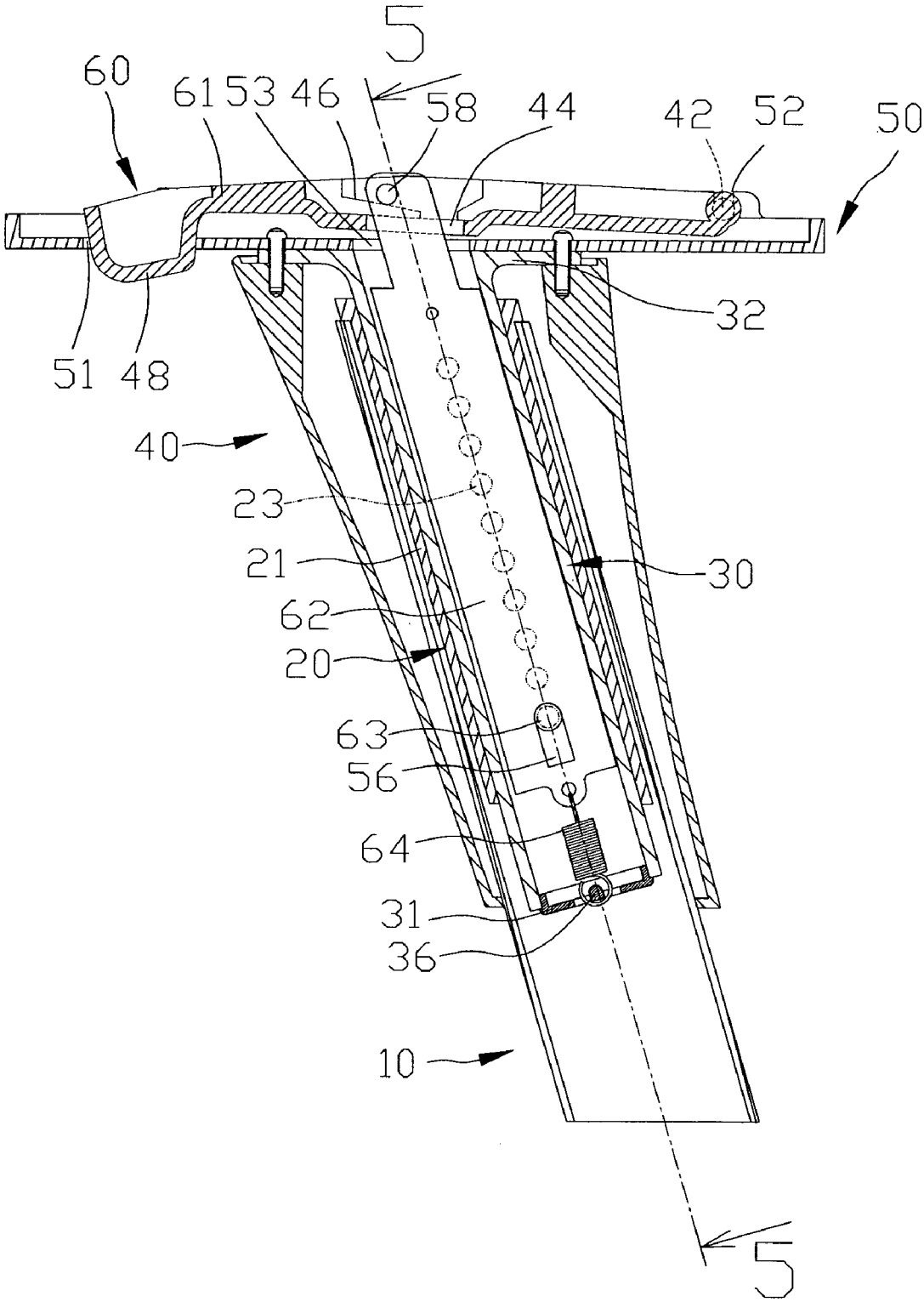
FIG. 4 is a cross-sectional view of the armrest shown in FIG. 2.
Figure 5:
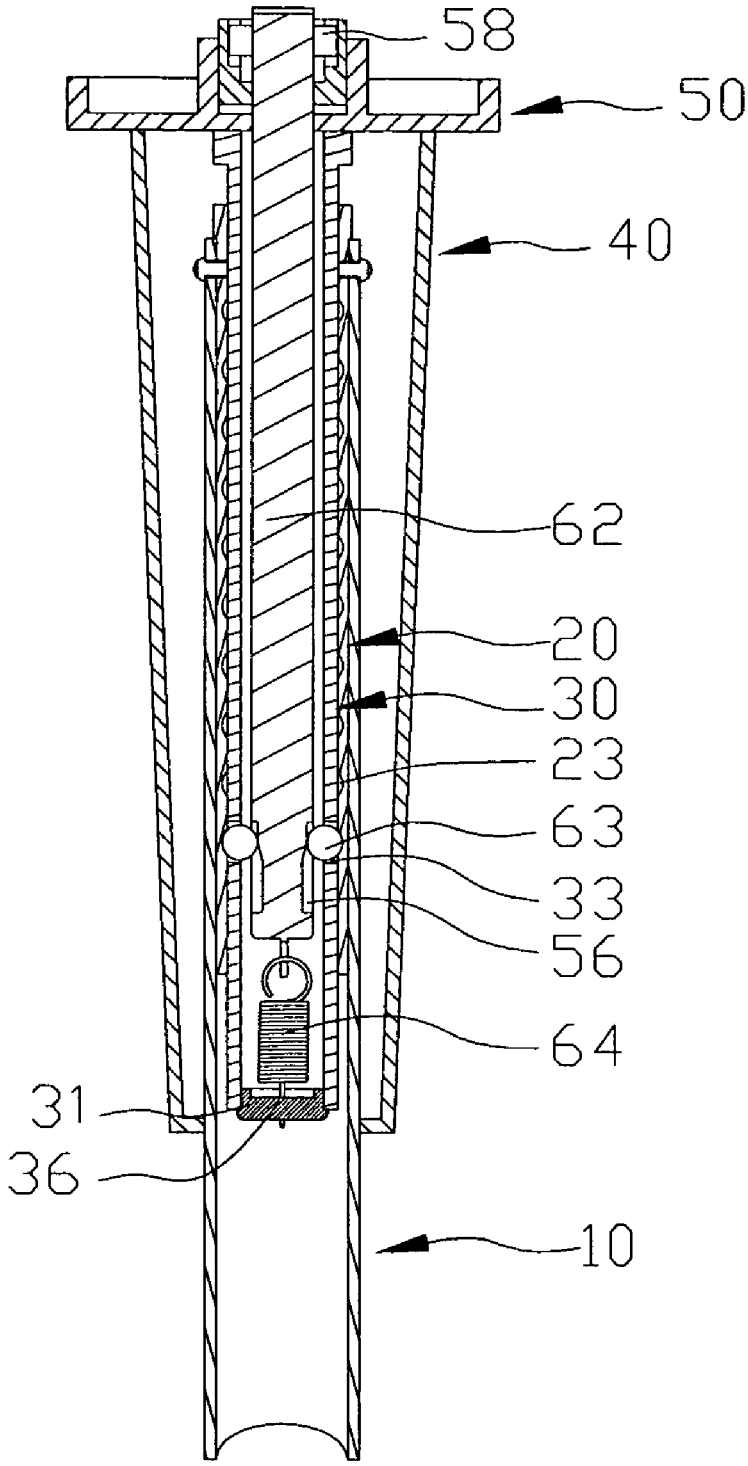
FIG. 5 is a cross-sectional view of the armrest taken along a line 5—5 in FIG. 4.

Referring to FIGS. 4 and 5, the button 48 is exposed through the first aperture 51 of the armrest 50. The rod 62 is kept in a normal position by the spring 64. The detents 63 are put in the shallow portions of the recesses 56. On the other hand, the detents 63 are put in a related pair of recesses 23. Hence, the third tube 30 is locked in position relative to the second tube 20.

Figure 6:
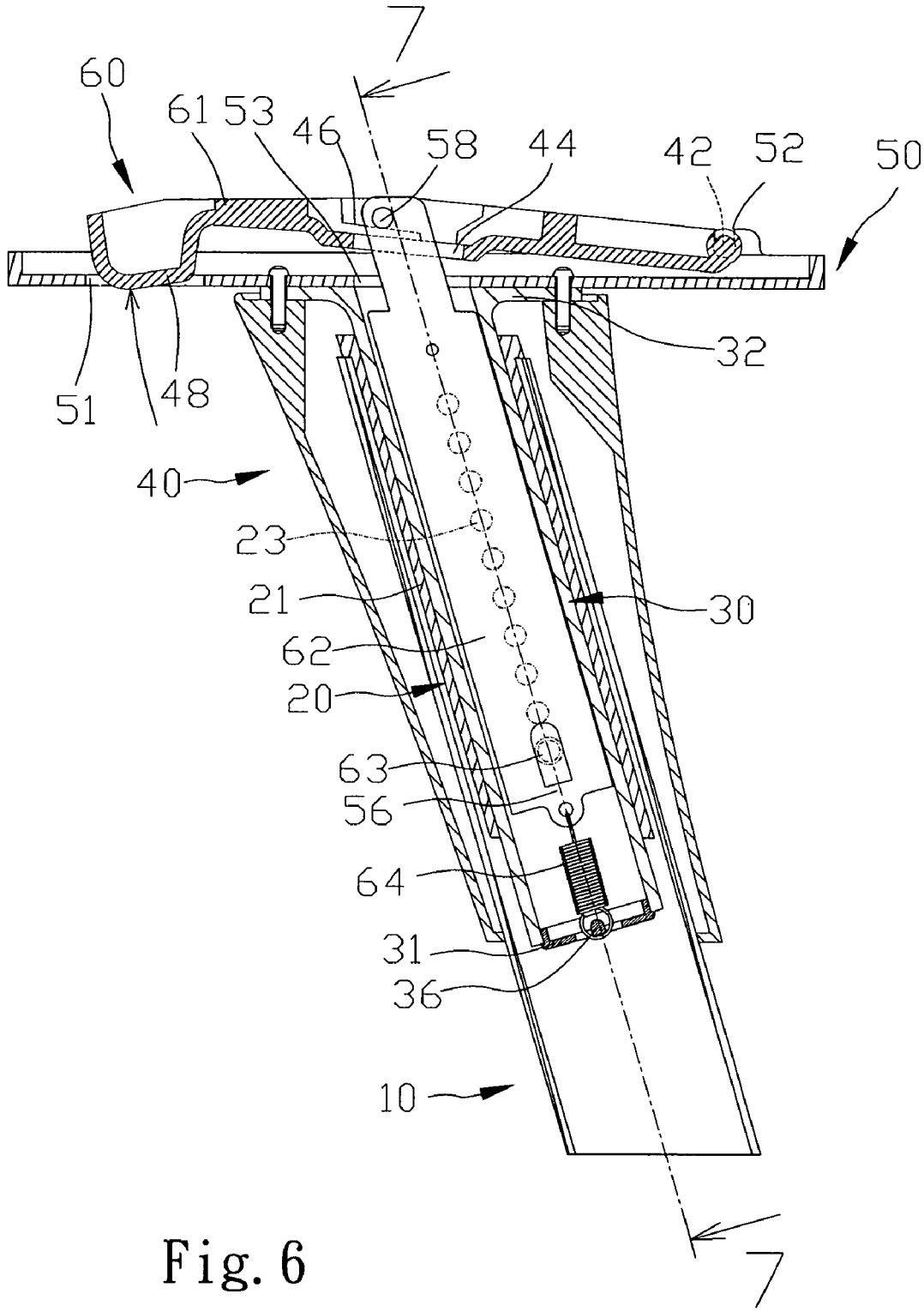
FIG. 6 is similar to FIG. 4 but shows the armrest in another position.
Figure 7:
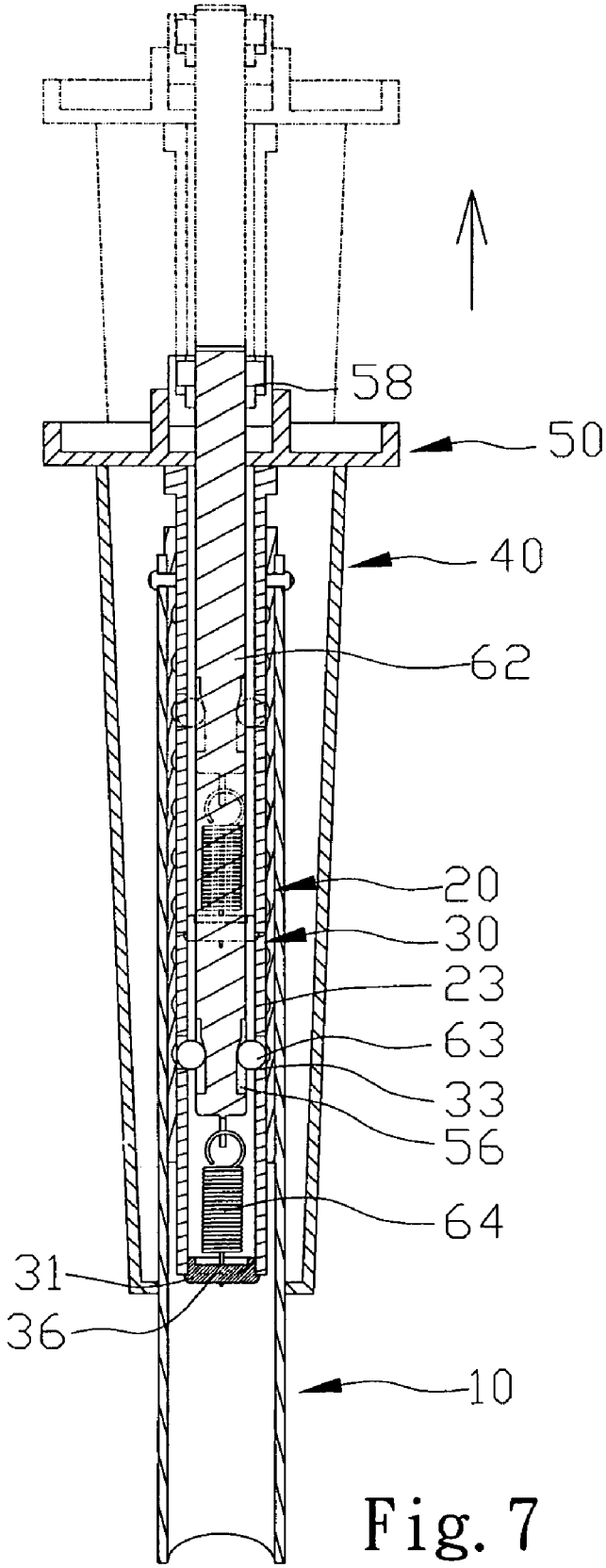
FIG. 7 is a cross-sectional view of the armrest taken along a line 7—7 in FIG. 6.

Referring to FIGS. 6 and 7, the button 48 is pressed into the first aperture 51 of the armrest 50, i.e., the lever 61 is pivoted upwards. The rod 62 is pulled upwards by the lever 61. The detents 63 are put in the deep portions of the recesses 56. On the other hand, the detents 63 are removed from the recesses 23. Hence, the third tube 30 can be moved relative to the second tube 20. The armrest 50 and the sleeve 40 are movable together with the third tube 30.

Figure 8:
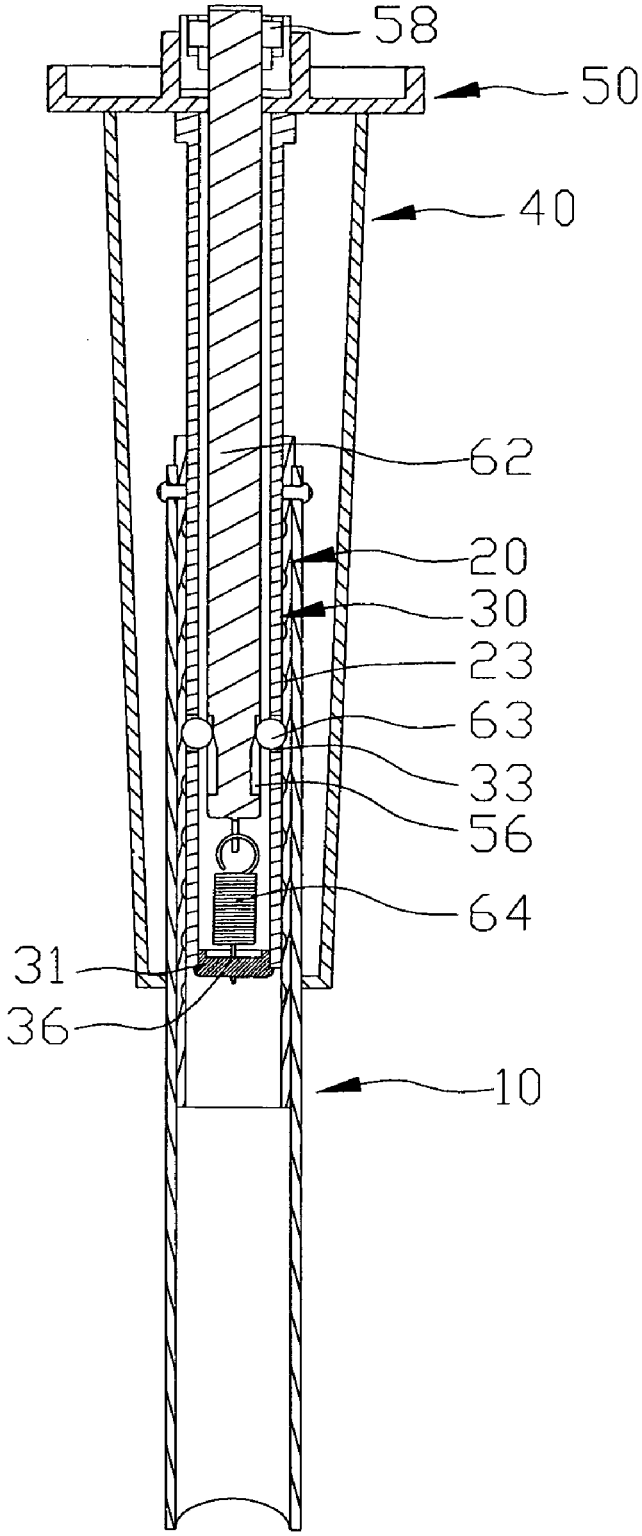
FIG. 8 is similar to FIG. 7 but shows the armrest in another position.

Referring to FIG. 8, when the third tube 30 is moved to a desired position, the button 48 is released. The rod 62 is returned to the normal position by the spring 64. As mentioned above, the detents 63 are put in the shallow portions of the recesses 56 on one hand and in a related pair of recesses 23 on the other hand. Hence, the third tube 30 is again locked in position relative to the second tube 20.

Figure 9:
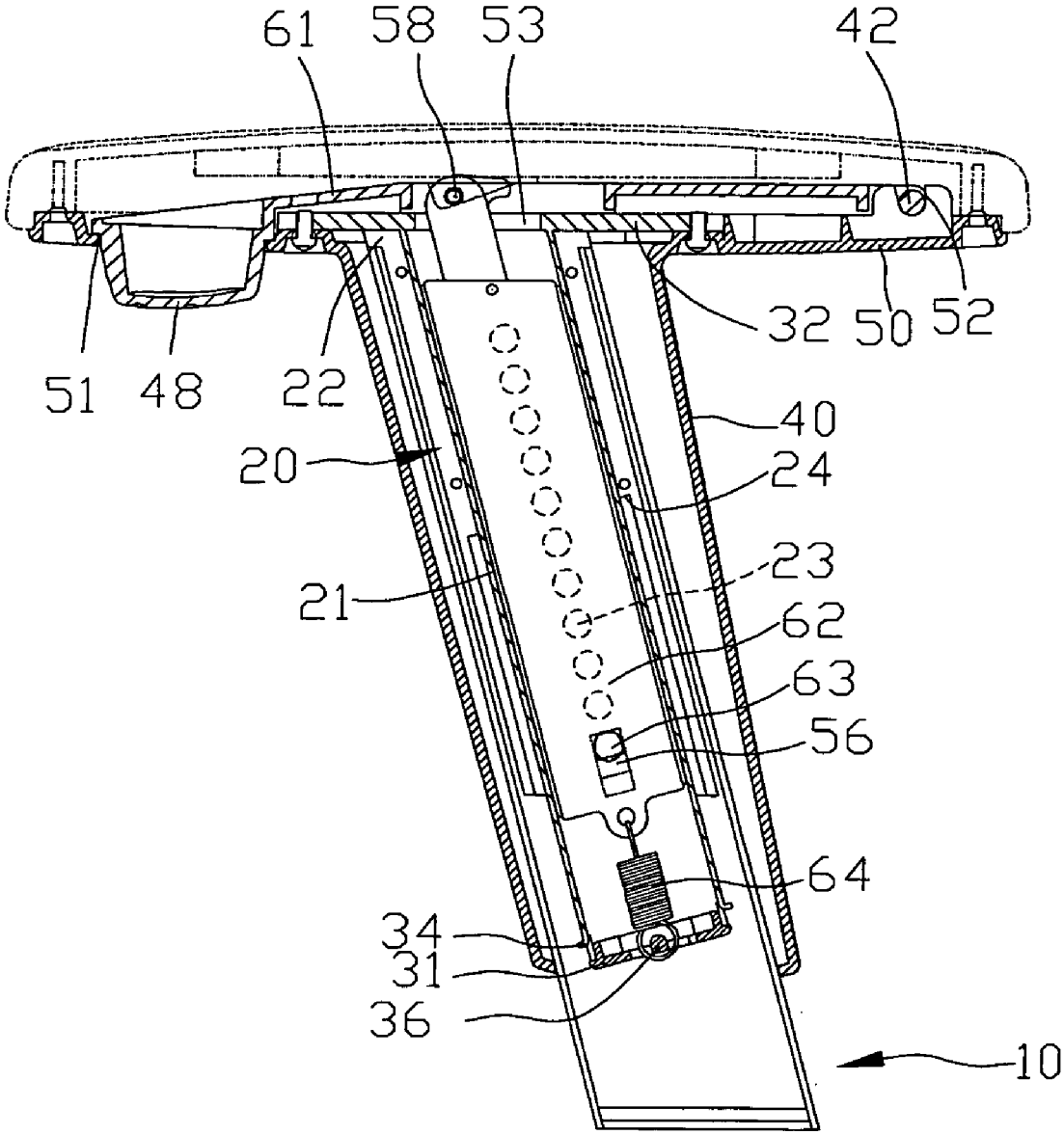
FIG. 9 is a cross-sectional view of an armrest according to a second embodiment of the present invention.
Figure 10:
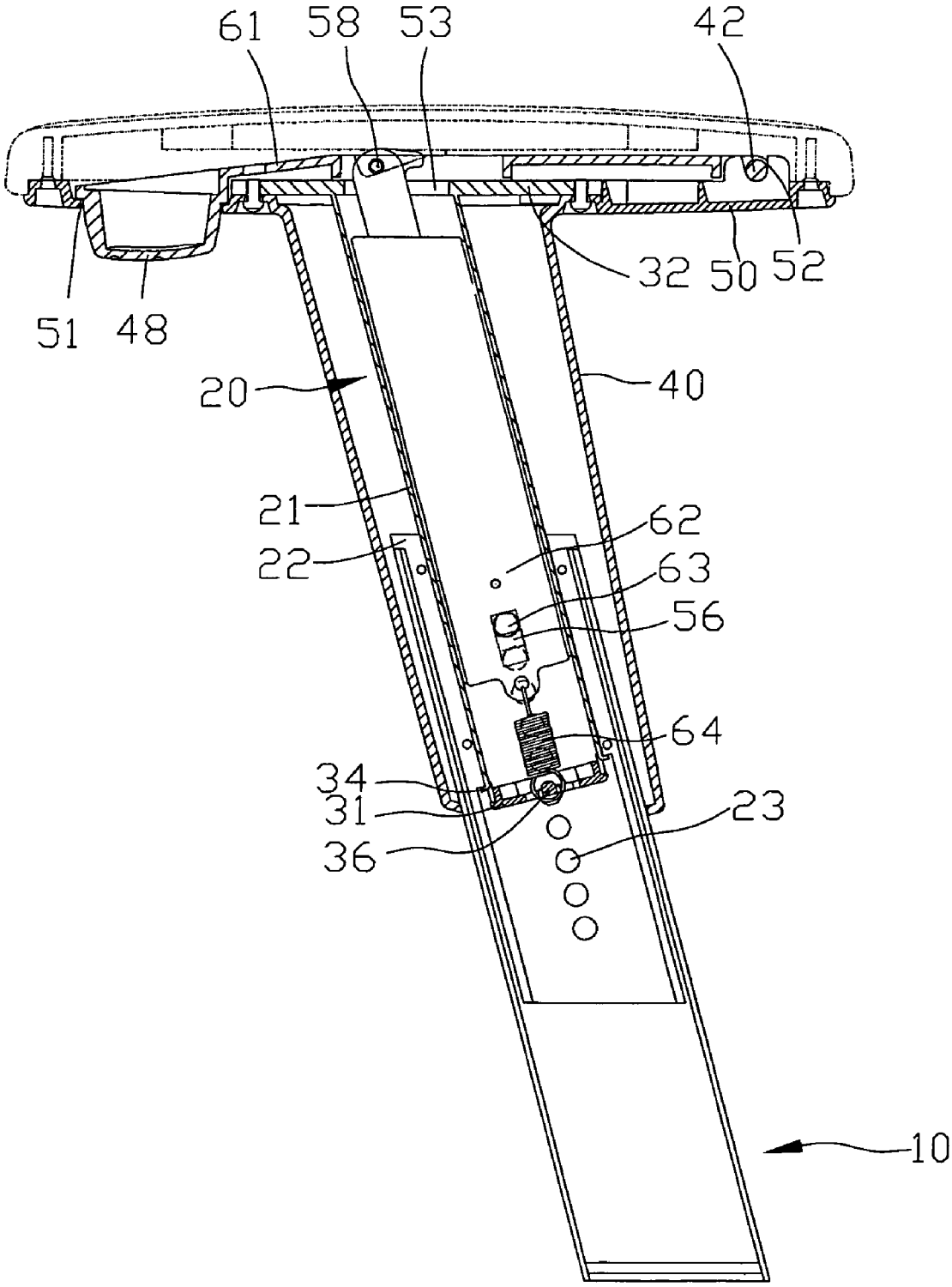
FIG. 10 is similar to FIG. 9 but shows the armrest in another position.
Figure 11:
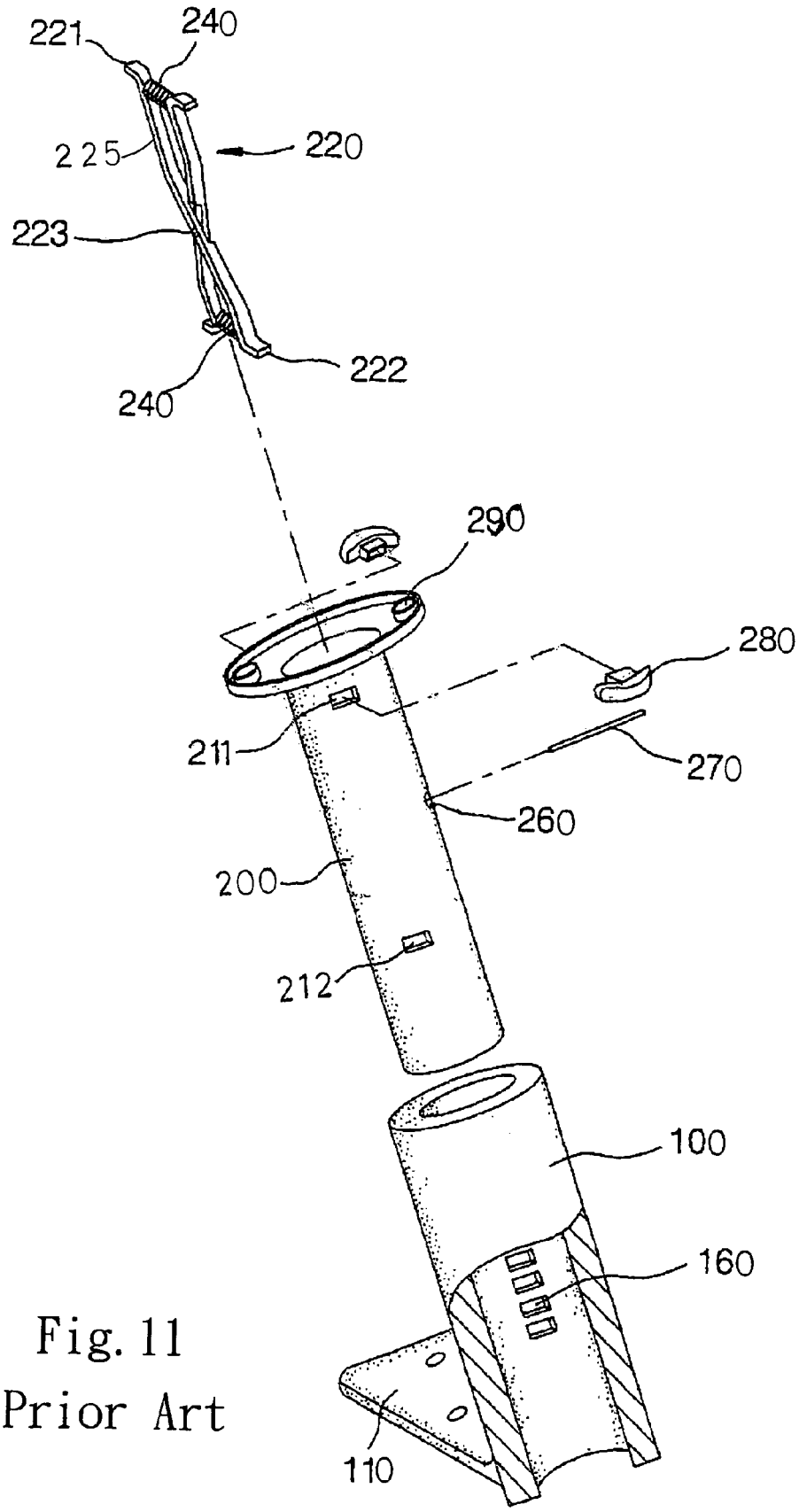
Fig. 11 Prior Art
FIG. 11 is an exploded view of a conventional armrest.
Figure 12:
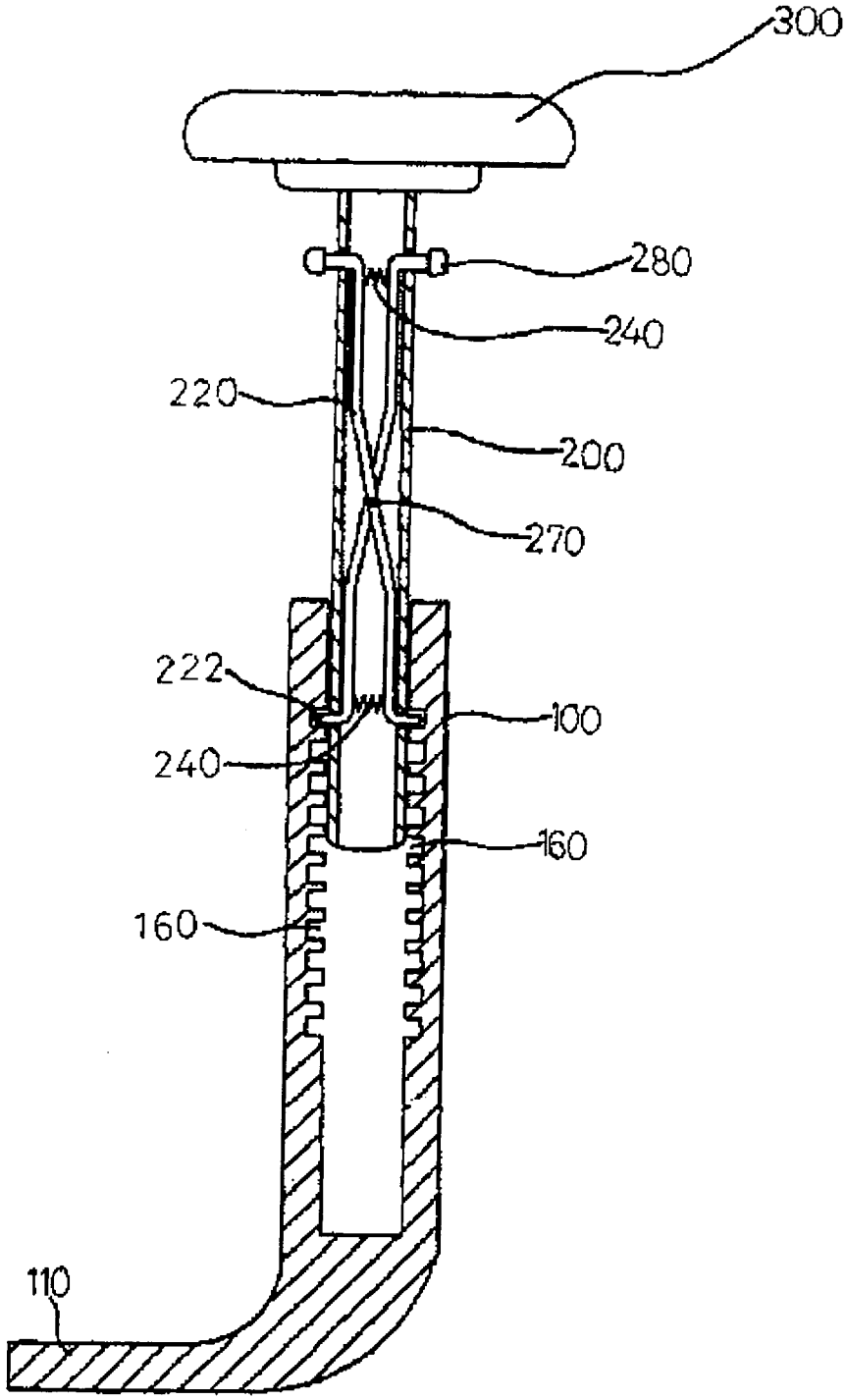
Fig. 12 Prior Art
FIG. 12 is a cross-sectional view of the armrest shown in FIG. 11.

FIGS. 9 and 10 show an armrest assembly according to a second embodiment of the present invention. The second embodiment is identical to the first embodiment except for three things. Firstly, the armrest 50 and the sleeve 40 are made as one piece. Secondly, a tubular stop 24 is fit in the second tube 20. Finally, the third tube 30 includes an annular flange 34 for abutment against the stop 24 so as to keep the third tube 30 telescopically inserted in the second tube 20.

The present invention has been described via detailed illustration of the embodiments. Those skilled in the art can derive variations from the embodiments without departing from the scope of the present invention. Therefore, the embodiments shall not limit the scope of the present invention defined in the claims.

What is claimed is:

1. An armrest assembly comprising:

a stationary tube for attachment to a chair, the stationary tube comprising recesses in an internal face;

a movable tube inserted in the stationary tube, the movable tube defining an aperture;

an armrest installed on the movable tube;

a detent for insertion into one of the recesses of the stationary tube through the aperture of the movable tube;

a rod put in the movable tube, the rod defining a recess for receiving the detent, the recess of the rod comprising a shallow portion and a deep portion; and a lever connected with the rod and installed on the armrest in order to move the rod so as to control the detent, wherein the armrest defines an aperture, wherein the lever defines an aperture aligned with the aperture of the armrest, wherein the rod is inserted in the movable tube through the aperture of the lever and the aperture of the armrest.

2. The armrest assembly according to claim 1 comprising a pad installed on the armrest.

3. The armrest assembly according to claim 1 wherein the armrest comprises two bearings formed thereon, wherein the lever comprises a shaft supported on the bearings.

4. The armrest assembly according to claim 1 wherein the armrest defines an aperture, wherein the lever comprises a button extending through the aperture of the armrest.

5. The armrest assembly according to claim 1 comprising a pin driven through the rod and supported on the lever.

6. The armrest assembly according to claim 5 wherein the lever defines two recesses for receiving two ends of the pin.

7. The armrest assembly according to claim 1 comprising an elastic element for connecting the rod with the movable tube.

8. The armrest assembly according to claim 7 comprising a plug fit in the movable tube, wherein the elastic element connects the rod with the plug.

9. The armrest assembly according to claim 1 comprising a sleeve attached to the armrest in order to cover the movable tube.

10. The armrest assembly according to claim 9 wherein the sleeve and the armrest are made as one piece.

* * * * *